United States Patent [19]

Ginn

[11] Patent Number: 4,680,916

[45] Date of Patent: Jul. 21, 1987

[54] STAGED DETERGENT/FABRIC TREATING PREPARATION FOR USE IN WASHING MACHINES

[76] Inventor: Martin E. Ginn, 9327 N. Kostner, Skokie, Ill. 60076

[21] Appl. No.: 837,217

[22] Filed: Mar. 7, 1986

Related U.S. Application Data

[62] Division of Ser. No. 689,455, Jan. 7, 1985, Pat. No. 4,588,080.

[51] Int. Cl.[4] ..... B65B 63/08

[52] U.S. Cl. ..... 53/440; 53/474

[58] Field of Search ..... 53/127, 266 R, 238, 53/239, 440, 473, 474; 206/219

[56] References Cited

U.S. PATENT DOCUMENTS

| | | | |
|---|---|---|---|
| 2,810,652 | 10/1957 | Armbruster | 53/440 |
| 3,371,460 | 3/1968 | Rait | 53/474 |
| 3,805,475 | 4/1974 | Glenn | 53/474 |

*Primary Examiner*—Robert L. Spruill
*Assistant Examiner*—Donald R. Studebaker
*Attorney, Agent, or Firm*—Michael G. Berkman

[57] ABSTRACT

A unitary package for use in the washing and in the conditioning treatment of fabrics in a laundering operation. There is provided a packet in which a multi-layer plug-like laminate is contained in and is bonded within a cup-like water-insoluble and water-impermeable receptacle having an open top. The laminate presents an exposed upper surface to the wash water in the tub of a washing machine. Only after the materials (for example, detergents) in the top layer of the laminate have dissolved and dispersed does the washing water reach to solublize the second layer containing the fabric conditioner (for example, a fabric softener). Thus, the article of the invention ensures the simple and highly reliable manner time-spaced sequential incorporation of two different functional agents into a fabric washing system, even though the agents are added simultaneously.

4 Claims, 2 Drawing Figures

STAGED DETERGENT/FABRIC TREATING PREPARATION FOR USE IN WASHING MACHINES

This is a divisional of application Ser. No. 689,455, filed Jan. 7, 1985, now U.S. Pat. No. 4,588,080.

BACKGROUND OF THE INVENTION

The present invention relates to compositions for use in the washing of fabrics in washing machines. More particularly, the invention is directed to a composite, unitary packet including, as distinct components, a detergent or washing composition and a fabric treating composition, and in which the several different components are released in a predetermined, controlled sequence.

Many different types of fabric washing preparations have been developed for use in rotary and agitator-type washing machines. The commercial embodiments of these washing compositions have taken various physical forms. The products currently being marketed include many and varied functional chemical ingredients for both general and specialized applications.

Special products, each intended to perform a principal limited function such as fabric cleaning, bleaching, fabric "softening" and freeing fabric of static electrical charges have been offered to the consumer. In addition, multi-purpose compositions which include two or more different functional components, intermixed or combined physically have also been widely promoted.

The addition, all at the same time, of seperate compositions such as detergents, fabric softeners, and anti-static agents into the tub of a washing machine has proven unsatisfactory in that interference and interaction between the various chemical ingredients occurs with the result that there is product deactivation and failure. As a result, the full intended function or role of at least one of the "special" agents added is not realized. In some instances a given functional utility is lost entirely.

The alternative procedure of adding each specialized product seperately but in turn, at sequential time-spaced increments of the washing operation, is exceedingly inconvenient in that it is necessary that one be present during and to follow the time-controlled stages of the washing cycle.

The problems described above have been recognized; various approaches have been explored to provide solutions. Products have been devised which contain multi-functional compositions, but which, upon introduction into a washing machine, act to release the different functional ingredients in a particular sequence, for example, the bleach being released only after the washing cycle has been in progress for some period of time.

The general method for achieving such delayed or sequential addition or incorporation of ingredients into a fabric washing system is to use specially controlled, multi-compartment pouches, bags, envelopes or sachets, including such structures having walls of varying water permeability. In other such pouches, the walls themselves are impermeable to water, but are water-disintegratable. water disintegrateable seals have been used to control or delay the release of a particular packaged ingredient. In still other arrangements a combination of water impermeable and water permeable walls and/or seals has been employed. The structural composition of the pouch walls themselves includes plastics, woven and non-woven fabrics, and porous walls of plastic or fabric, but coated with a permanent water sealant film or with a film which dissolves in water at a rate dependent upon the coating composition and the thickness.

In still other arrangements the release of a particular ingredient from a given compartment of a composite package has been rendered temperature-dependent so that above a critical temperature the confining wall disintegrates or becomes permeable to the encapsulated, or confined ingredient. Another method to achieve a time-spaced, sequential release of two component compositions has been totally to encapsulate or to encase one component physically within the other. In still another type of arrangement coatings the solubility of which depends upon the pH of the ambient aqueous system are used to control the release of a confined composition.

In some of the packages of the type referred to, the precise properties, including the critical solubilities of the structural walls of the pouches used, have been difficult to control. Requisite reliability and consistency of operation have not been realized. Others of the packages have lacked the physical strength and have fractured or otherwise failed during shipment and handling. In still others fusion seals or adhesive seals have opened prematurely or have failed to open as intended, or have otherwise proved unreliable and inoperative. Products of the encasement or encapsulation type and without protective mechanical enclosures have fractured prematurely resulting in simultaneous dissolution thus obviating the intended utility.

It is, therefore, a principal aim of the present invention to provide a multi-functional fabric washing and treating product in which separate components are released into the washing system sequentially, at time-spaced intervals, in a controlled manner, and in which shortcomings and deficiencies of prior art preparations have been overcome.

SUMMARY OF THE INVENTION

In accordance with the present invention there is provided a unitary, composite packet including a fabric washing composition and a fabric treating agent contained in an open-top receptacle. The article of the invention makes it possible to add all desired washing materials into a washer simultaneously in a laundering operation while also ensuring that the different components are automatically released in a predetermined time-spaced, controlled sequence.

In a preferred embodiment of the invention the packet consists of a plug-like, multi-layer laminate bonded to or otherwise sealed contiguously against the base and to a circumscribing bounding wall of a plastic, cup-like receptacle. In the physical arrangement described, initial access of washing solution to the laminate is limited to an exposed top surface only of an uppermost layer of the laminate.

It is an important feature of the packet of the invention that the layers of the materials in the laminate are arranged to define an order, from top to bottom, correlated with a particular dissolution sequence desired.

In a preferred embodiment of the invention a top, exposed layer of the laminate, and the first to be dissolved in the wash water, is a detergent composition, and the layer therebeneath, the next to be dissolved, is a fabric softener and anti-stat.

A related functional feature of the invention is that dissolution of the various definitive layers in the laminate occurs in a free-programmed, predetermined sequence, with the outermost layer being essentially completely dissolved and functioning in the washing solution before the next layer is brought into solution.

An important feature of the invention is that packaging films or fabrics which are difficult to control as to their water permeability are avoided.

A related feature of the invention is its simplicity, the need for barriers of controlled permeability and the need for plastic-to-plastic seals being eliminated.

A practical advantage of the packet of the invention is that it is rapidly and effectively assembled without resort to special techniques such as heat sealing, fusion, and without the use of special machines or devices.

It is a feature of the invention that dissolving delay and sequence control are achieved through an essentially water-tight seal established between the lateral wall of the layered laminate and the contiguous bounding wall surface of the circumscribing receptacle, thus ensuring that the dissolution rate of the top, exposed disc or wafer material of the laminate constitutes that parameter which determines the time delay before entry of the next, lower layer into the washing solution.

A utilitarian feature of the composite assembly of the invention is that the introduction of the fabric treating component is effectively delayed until essentially all of the detergent fraction has dissolved in the wash water.

A related feature of the packet of the invention is that the delay between dissolution of the detergent composition and dissolution of the fabric conditioner is conveniently adjustable, in the range of from about 2 to about 6 minutes.

A related feature of the invention is that sequential addition of the several different componenets of the packet is achieved without interrupting the washing cycle and without any demand on the time or attention of the user.

The packet of the invention facilitates the simultaneous presentation to the washing system of two or more separate and distinct laundry ingredients while providing that the dissolution of each occurs at predetermined, controlled, time-spaced intervals in a selected sequence.

Yet another feature of the invention is that the packet contains a premeasured aliquot of each of various functional agents obviating the need to measure out or to mete out the several individual ingredients used in the fabric washing operation.

The present invention is further characterized in that the carrier or receptacle in which the several distinct components of the chemical laminate are contained may be fabricated of any of a diverse group of inert, water-soluble materials such as molded or formed plastic.

An advantageous marketing feature of the packets of the invention is that they may be conveniently packed or displayed as an internesting lineal array in an attractive tubular package, with attendant economic employment of space.

In a preferred embodiment of the present invention, the second (lower) layer, for example fabric softener, in the receptacle does not dissolve and will not deposit on the fabric until the rinse cycles have been reached and a major degree of cleaning has been completed. The softener, therefore, does not interfere with the cleaning process.

Other and further objects, features and advantages of the invention will become evident from a reading of the following detailed description considered in conjunction with the drawings.

DESCRIPTION OF PREFERRED EMBODIMENTS

Figure 1:
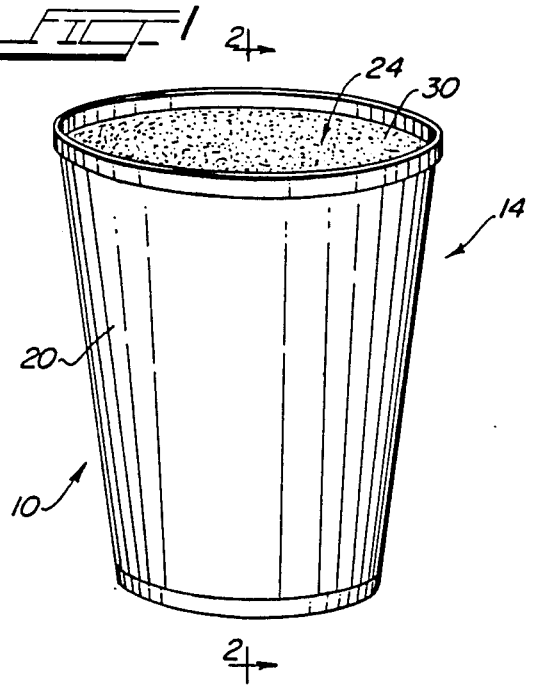
FIG. 1 is a perspective view of the packet of the invention showing the container with its encased laminate.
Figure 2:
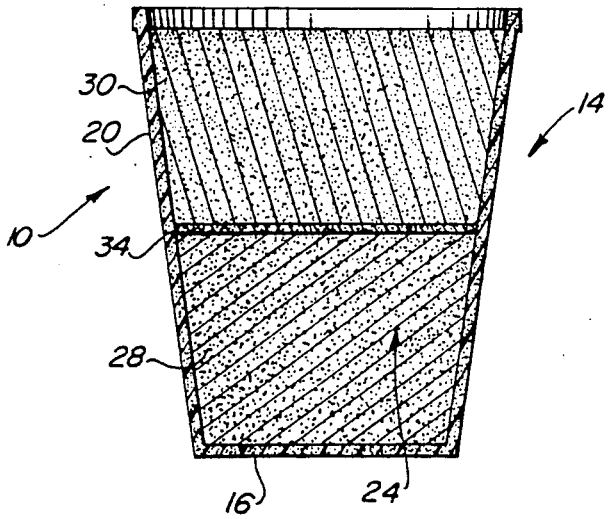
FIG. 2 is a schematic, cross-sectional view representation of a packet according to the invention, incorporating the features thereof, and showing a plastic receptacle containing a multi-layered plug-like laminate contiguously bonded to the floor and to the bounding wall of the container.

The aims and objects of the invention are realized by providing, in an article for use in a washing machine, a unitary packet including an open-top, dish-like receptacle which serves as a housing for a multi-layer, plug-like laminate.

In a preferred embodiment of the invention the laminate is formed of a lower, disc-like layer of a fabric conditioner bonded to the floor and to the circumscribing sidewall of the receptacle in contiguous, fluid-tight abutment. Superimposed on the lower layer, and bonded thereto and to the confining receptacle wall, is a second layer which constitutes a washing agent.

When the article is introduced into the washing water, the exposed washing agent layer dissolves and is dispersed to effectuate its intended cleaning role. Only after a finite delay period, correlated with the time required for the top layer of the laminate to dissolve (about 2 to about 6 minutes depending on the particular formulation and upon the wash water temperature, etc.) will the fabric conditioner enter the washing solution. Thus, a simple yet most effective procedure has been provided for releasing two functionally different laundering compositions into a fabric washing system in an optimum, predetermined, time-spaced sequence. It will be appreciated that the rate of solution of each layer of the composite laminate can be adjusted, controlled and varied, as desired, by altering the specific composition utilized.

In the specific embodiment of the invention described above, the addition and the functional availability of fabric conditioner, for example, is deferred until the washing agent or cleansing composition has had sufficient time to act effectively on the fabrics in the wash machine. The two distinct and different functions occur, optionally, in a predetermined time delay sequence, even though both compositions are introduced into the wash system simultaneously.

Optionally, other functional compositions, delineated by additional distinct "layers" may be used for special applications and generally to enhance the washing operation.

Referring now to the drawing, there is shown, for purposes of illustrative disclosure and not in any limiting sense, a packet 10 embodying the features of the present invention. The packet 10 is in the form of an open-top, dish-like or cup-like receptacle or container 14 of a generally cylindrical or tubular configuration and having a flat base or floor 16 with an integrally formed, circumscribing, upwardly-extending wall 20. In the specific example depicted, the receptacle is of a water-impermeable and water-insoluble, light-weight foamed plastic (for example, closed cell molded polystyrene) such as used commercially in throw-away drinking cups.

As indicated schematically, the receptacle 14 contains a laminate 24 consisting of two contiguous layers 28 and 30 in superimposed relationship. Each layer constitutes a distinct physical composition; each performs a different, important function in a fabric washing system. In the example shown, the lower layer 28 is a fabric conditioning, for example, a fabric softener and anti-static agent. The upper layer 30 is a washing agent.

The term "washing agent" as used herein is intended to include one or more of soaps, synthetic organic detergents, water conditioners, binders, builders, sequestrants and anti-soil and redeposition additives.

The term "fabric conditioner" may include such ingredients as softeners, anti-static agents, brighteners, dispersing agents, and binders.

Neither the dimensions of the cup 14 or the cup configuration are critical. A cup about 2 inches in average diameter and having a height of about 1½ inches and a wall thickness in the range of about 1/16 inch has been found to be quite suitable as a container in which the height of each of the two housed layers is about 9/16 inch. As indicated schematically, this arrangement will provide a slight head space of about ¼ to about ½ inch. In the specific embodiment shown, the cup has slight upward and outward flair.

It is important, however, that each of the contained layers, especially the top layer 30 of the laminate 24 be firmly and contiguously bonded in fluid-tight adhesion to the bounding, circumscribing wall 20 of the receptacle 14. Such fluid-impervious bonding ensures that the lower, fabric conditioning layer 28, does not go into the washing system until the upper, washing agent layer 30 has dissolved and dispersed in the wash system.

With the physical arrangement as described, the fabric treating composition 28 will not enter into the washing solution to act upon the fabrics until the washing agent (the upper layer 30) has been at its work for about 2 to about 6 minutes. Preferably, the fabric conditioner 28 will first come into contact with the fabrics during a rinse cycle, after the wash machine has cycled through a major fraction of the washing period.

In the specific embodiment of the invention illustrated, the cup 14 contains about 15.5 grams of fabric conditioner (a "softener" blend) as the lower layer 28 and about 33 grams of a washing agent (detergent blend) as the upper layer 30. Generally, the amount of fabric conditioner may lie in the range of from about 7 to about 30 grams, and the amount of washing agent in the range of from about 15 to about 50 grams.

The product of the invention is conveniently assembled by first heating the fabric conditioner composition to form a fluid slurry. The slurry is poured, while hot, into the cup 14 where, upon cooling, it forms a solid waxy wafer 28 or layer. The washing agent composition, mixed and heated to form a fluidized mass, is then poured into the cup 14 on top of the lower layer and, upon cooling, bonds thereto and to the sidewall 20 of the cup 14. A unitary, composite container and bonded plug-like laminate results—ready for use.

In a somewhat modified procedure, a small quantity of a powdered potassium carbonate, a polyelectrolyte or equivalent chemical agent may be sprinkled on the surface of the fabric conditioner layer 28 as an interface medium 34 before pouring the washing agent into the assembly. This refinement establishes a definitive demarcation and serves to enhance seperation of the two principal components of the laminate during the dissolution process.

DETAILED EXAMPLES OF PREFERRED ENFORMULATIONS

It will be appreciated that, within the teachings and intended use of the present invention, many varied, different formulations of both the "washing agent" and the "fabric conditioners" may be utilized. In the following sections of the specifications typical examples of suitable blends are described. The principal functional roles of each component ingredient are identified, and preferred concentration ranges are given. (Tables I and II).

softner I

Fabric Softner Composition Formulations

| Ingredient No. | Compound | Concentration | Function |
|---|---|---|---|
| 1. | 28.0% Ditallow-Alkyl Dimethyl Ammonium Chloride | 10.0 to 40.0% | Primary fabric softener and antistat agent |
| 2. | 18.6% Dioleyl Alkyl Imidazolinium Methyl Sulfate | 5.0 to 30.0% | Secondary fabric Softener and antistat, rewet additive, co-solublizer |
| 3. | 15.5% Isopropyl alcohol | 3.5 to 18.0% | Solvent for cationic fabric softeners |
| 4. | 12.4% Trisodium salt of nitrilo-triacetic acid | 2.5 to 25.0% | Aid in dispersing softener blend. Also a water softener |
| 5. | 6.2% Nonyl-phenol −10 mole ethoxylate | 2.0 to 14.0% | Surfactant disperser for cationics |
| 6. | 12.3% Polyoxy-propylene (POP) polyoxyethylene (POE) block copolymer | 4.0 to 25.0% | Binder and surfactant disperser for cationics. |
| 7. | 6.2% Propylene glycol | 0.0 to 15.0% | Cosolvent |
| 8. | 0.7% Optical brightener (cationic-compatible) | 0.1 to 1.5% | Fabric optical brightener |
| 9. | 0.1% Dye or colorant | 0.01 to 0.2% | Colorant for softenerr layer |
| 10. | q.s. perfume, water | 0 to 3% | |

TABLE II

Washing Agent Formulations

| Ingredient No. | Compound | Concentration | Function |
|---|---|---|---|
| 1. | 19.0% POP/POE block copolymer | 8.0 to 30.0% | Binder and surfactant |
| 2. | 44.6% Nonylphenol −10 mole ethyxylate | 20.0 to 55.0% | Basic non-ionic detergent ingredient |
| 3. | 21.1% Trisodium salt of nitrilo-triacetic acid | 4.0 to 30.0% | Water softener, calcium/magnesium sequestrant, detergent builder |
| 4. | 5.8% Potassium carbonate | 1.0 to 12.0% | Detergent builder, alkalinity agent |

TABLE II-continued

Washing Agent Formulations

| Ingredient No. | Compound | Concentration | Function |
|---|---|---|---|
| 5. | 3.2% polyvinyl-pyrrolidone (PVP) | 1.5 to 4.5% | Cationic-compatible, anti-soil redeposition additive |
| 6. | 4.2% Propylene gylcol | 0.0 to 6.0% | Cosolvent, Solublizer |
| 7. | q.s. colorant, perfume, water | 0.0 to 3.0% | |

Alternative compounds may be substituted for the primary and secondary softeners and the other functional ingredients of the softener formulation. Possible alternative components are listed below, keyed with reference to the numbered categories identified above as "Ingredient No.".

Ingredient No. Key (1)

C-12, C-14, C-16, C-20, C-22, di-alkyl dimethyl ammonium chlorides, bromides, methyl sulfates and blends thereof, including deriving alkyl groups from coconut oil, palm oil, soya and oleyl fatty acids. Mono-alkyl trimethylammonium salts of the above and including mono-tallow alkyl constituents.

Ingredient No. Key (2)

C-12, C-14, C-16, C-18 (tallow alkyl), C-20, C-22 di-alkyl dimethyl imidazolinium methyl sulfates and blends thereof, including alkyl groups derived from coconut, palm oil, soya, and oleic fatty acids. Also ethoxylated quaternaries.

Ingredient No. Key (1)–(2)

Other cationic candidates may be selected from the generic types of: (a) cylical alkylammonium compounds, including as examples: pyridinium, quinolinium, isoquinolinium, phthalzinium, benzimidazolinium, benzothiazolium, benzotriazolium, pyrrolidinium, and various imidazolinium derivatives (unsaturated heterocyclic compounds); or may possess saturated ring structures, such as: piperidinium, morpholinium, thiamorpholinium, piperazinium, 1,3-benzoxizinium; 1, 3, 5-trialkylexahydro - 1, 3, 5-triazinium derivatives, or N-hexahydroazepinium derivatives. They may be derived from petroleum, or may be polymeric, or may be non-nitrogen-containing cationics such as: sulfoxonium and sulfonium compounds, phosphonium compounds, or iodonium compounds to mention some examples. (See reference 3). Bisquaternaries are also included as candidate cationic surfactants.

Ingredient No. Key (3)

Propylene glycol, low molecular weight polyoxyethylene glycols, nonionic surfactants (e.g. nonylphenol-10 mole ethoxylate), alkyl monoethyl ethers (e.g. butyl cellosolves, etc.

Ingredient No. Key (4)

Potassium salts of nitrilotriacetic acid. Sodium and potassium salts of ethylene-diaminetetraacetic acid; pyro-tripoly-hexameta-phosphates; glassy phosphates. Potassium and sodium carbonate; low molecular weight polyelectrolytes such as ethylene-maleic anhydride copolymers or polyacrylates. Potassium and sodium salts of citric and gluconic acids.

Ammonium and moni-, di, and tri-ethanolammonium salts of the above.

Ingredient No. Key (5)

Hexyl-, heptyl-, octyl-, nonyl-, decyl-, undecyl-, dodecyl-, tetra-decyl phenol 5–20 mole ethoxylates. Secondary and primary alcohol (C-10 to C-22)—5 to 30 mole ethoxylates.

Polyolefin-derived ($C^8$ to $C^{20}$) alcohol—5 to 30 mole ethoxylates. $C_{10}$–$C_{22}$ fatty acid 5 to 30 mole ethoxylates including abietyl acid derivatives. Epichlorohydrin and other intermediary bridged nonionics. Polyoxethylene/polyoxypropylene block copolymers of ethylene glycol (Pluronics), products of BASF Wyandotte Corporation, polyoxyethylene/polyoxypropylene block copolymers of ethylene diamine. (Tetronics), product of BASF Wyandotte Corporation. Sucrose esters, polyoxyethylene sorbitol esters, amine oxides e.g. alkyl dimethyl amine oxides.

Ingredient No. Key (6)

Same as above, but with EO (ethylene oxide) or PO (propylene oxide) ranges high enough to produce solid surfactants at room temperature. For example with ethoxylates, the EO mole ratios for solids would be appropriately 20–40.

Ingredient No. Key (7)

Isopropyl alcohol, ethanol, nonionic surfactants, low molecular weight polyoxyethylene glycols.

Ingredient No. Key (8)

Cationic-compatible fabric brighteners such as Tinopal LPW or Tinopal UNPA free acid, based on diaminostilbene disulfonic acids/cyanuric chloride. (Products of Ciba-Geigy).

Ingredient No. Key (9)–(10)

Dyes and perfumes may be selected from numerous candidates which are cationic-compatible.

Alternative ingredients as specially identified above with respect to cationic blend components but omitting cationics may be used. Additionally, with respect to ingredient (6) polyvinylalcohol (PVA) and PVA/PVP blends may be used.

The cup or receptacle 14 of the packet 10 in which the fabric cleaning and conditioning compositions are contained may be any of preferred-insoluble and water-impermeable plastics. In addition to polystyrene, containers fabricated of cellulose acetate, polyolefins, polycarbonates, and polyvinylchloride are suitable. Butadiene, isoprene and vinylidene halide polymers as well as halo alkane polymers and acrylates may be used.

While the invention has been described with reference to specific preferred embodiments, such examples are not to be construed as a basis for limiting the scope of the invention itself. That is, although the chemical components in the exemplary forms of the invention are identified as a "washing agent" and a "fabric conditioner", other functional compositions such as a bleaching preparation or enzyme mixture may be used, either instead of or in addition to the washing agent and the fabric conditioner. Suitable "solid" bleaches are well known in the art.

Clearly, the invention is not to be viewed as limited to a two-layer laminate. Three or more layered products, each layer performing its own unique functional role, and in a predetermined time-spaced sequence, are within the inventive concept of the present invention.

What is claimed is:

1. The method of preparing a composite multi-layer plug including as physically distinct elements a fabric washing agent and a fabric conditioner, and in which said washing agent and said conditioner are bonded to one another to constitute a unitary assembly, said plug functioning in a tub of a washing machine and being operative to delay dissolution release of the fabric conditioner until a substantial portion of the washing agent has dissolved in and has dispersed throughout the washing solution during a wash cycle of a washing operation, said method including the steps of:

preparing a concentrated fabric treating composition as a heated, fluidized slurry, introducing said slurry into a water-impervious, water-insoluble cup-like receptacle to define a base layer therein, cooling said slurry to form a solid pellet-like disc bonded contiguously to a floor and to a circumscribing bounding wall of said receptacle, preparing a heated concentrated detergent mixture in a fluidized form, adding said mixture to said container intimately to overlie said disc, cooling said detergent mixture to effect an intimate bond with a top surface of said disc to form a multi-layer plug, and to establish a fluid-tight seal of said plug to a circumscribing wall of said receptacle, and retaining said plug within aid container for ultimate introduction of said plug and said container into a tub of a washing machine.

2. The method as set forth in claim 1 and further comprising the step, conducted after cooling of said base layer and prior to adding said detergent mixture, of coating a top surface of said base layer with a particulate alkali metal carbonate to enhance dissolution separation of the detergent mixture from the fabric conditioner.

3. The method as set forth in claim 1 and further comprising the step of adding said receptacle containing said multi-layer plug to the washing solution in a fabric washing machine.

4. The method as set forth in claim 1 and further comprising the step, conducted after cooling of said base layer and prior to adding said detergent mixture, of coating a top surface of said base layer with a particulate polyelectrolyte to enhance dissolution separation of the detergent mixture from the fabric conditioner.

* * * * *